US005853539A

United States Patent [19]

Smith et al.

[11] Patent Number: 5,853,539

[45] Date of Patent: Dec. 29, 1998

[54] METHOD OF APPLYING DRY STRENGTH RESINS FOR MAKING SOFT, STRONG, ABSORBENT TISSUE STRUCTURES

[75] Inventors: Michael John Smith, Neenah; Stephen John McCullough, Fond du Lac, both of Wis.

[73] Assignee: Kimberly-Clark Worldwide, Inc., Neenah, Wis.

[21] Appl. No.: 897,327

[22] Filed: Jul. 21, 1997

[51] Int. Cl.[6] ..... D21H 21/18

[52] U.S. Cl. ..... 162/112; 162/135; 162/136; 162/175; 162/178; 162/184; 162/189

[58] Field of Search ..... 162/112, 158, 162/164.1, 135, 168.2, 136, 169, 175, 178, 168.3, 189, 184

[56] References Cited

U.S. PATENT DOCUMENTS

| | | | |
|---|---|---|---|
| 1,914,869 | 6/1933 | Rowe | 162/112 |
| 4,063,995 | 12/1977 | Grossman | 162/112 |
| 4,886,579 | 12/1989 | Clark et al. | 162/112 |

*Primary Examiner*—Peter Chin
*Attorney, Agent, or Firm*—Gregory E. Croft

[57] ABSTRACT

Dry strength additives used to enhance the properties of creped tissues are applied to the surface of the Yankee dryer along with the creping adhesive formulation and thereafter transferred to the tissue web as the tissue web is being adhered to the Yankee. When dry strength agents are applied in this manner, less dust and lint are accumulated resulting in improved productivity and product quality.

7 Claims, 1 Drawing Sheet

METHOD OF APPLYING DRY STRENGTH RESINS FOR MAKING SOFT, STRONG, ABSORBENT TISSUE STRUCTURES

BACKGROUND OF THE INVENTION

The use of softening and strengthening agents in the manufacture of tissues, such as facial and bath tissue, is common practice in the industry. These tissues typically contain a blend of relatively long fibers, which are usually softwood fibers, and relatively short fibers, which are usually hardwood fibers. The softening and strengthening agents may be separately added to these different fiber species prior to or after blending the fibers together and forming the tissue web. Preferably, the softening agent is added to the short fibers since the short fibers primarily contribute to tissue softness. The long fibers are separately treated with strengthening agents (wet and dry) and refining. Both refining and strengthening agents are used because excessive use of either treatment may have an adverse effect on the tissue making process and/or the resulting tissue product.

Dry strength resins are often added to tissue products to impart integrity to the sheet during manufacturing and dispensing. An adequate level of dry strength is needed to provide good sheet handling to prevent breaks at the tissue machine reel or during converting. However, there are problems associated with wet-end addition. This adds expense (chemical delivery system, etc.) and requires constant monitoring to maintain dry tensile specification. It does little to minimize dust accumulation in manufacturing (often a source of sheet breaks), converting, or lint in the final product. Dry strength resins often have a relatively short shelf life due to their propensity to degrade over time due to microbial growth. Higher temperature and humidity can exacerbate this phenomena.

Therefore there is a need for a more efficient method of utilizing dry strength agents in the manufacture of tissue products.

SUMMARY OF THE INVENTION

It has now been discovered that an especially soft and strong creped tissue can be produced by the indirect addition of dry strength agents to the tissue web by applying the dry strength agents to the surface of the Yankee dryer, such as by spraying. More specifically, dry strength agents can be included as part of the creping adhesive formulation, which is sprayed onto the surface of the Yankee dryer between the creping blade and the pressure roll. The dry strength agents are subsequently transferred to the tissue sheet surface as the sheet is pressed against the Yankee dryer.

The dry strength agent requires time to dry and form hydrogen bonds with cellulose to fully develop its strength potential. A portion of the dry strength agent transfers to the surface of the tissue sheet in the pressure roll nip. However, in the short period of time which elapses between addition of the dry strength agent to the tissue sheet and subsequent creping, some dry strength agent is imparted to the sheet. Nevertheless, a portion of the dry strength agent passes through the tissue sheet and becomes recycled to the wet end of the tissue machine with the white water. This material preferentially attaches itself to the fines in the white water and becomes part of the newly-formed tissue web when those fines are trapped within the web during formation. The net result is that the dry strength agent added at the Yankee imparts dry strength to the creped tissue web through two mechanisms, one being the surface addition of the dry strength agent and the other being the more uniform addition via recycle of the white water. Unexpectedly, the amount of dust accumulated during manufacturing and converting is much less than that obtained with conventionally applied (wet-end) dry strength agents. Also, the amount of dust in the package and finished product is also reduced, thereby providing a more desirable tissue product for the consumer. Although not bound by theory, it is believed that the increased presence of the dry strength agent on the tissue surface and on the fines is responsible for the observed reduction in the amount of dust and lint.

Hence the invention resides in a method for making creped tissue comprising: (a) forming a wet tissue web by depositing an aqueous papermaking furnish onto a forming fabric; (b) partially dewatering the tissue web; (c) applying a creping adhesive and one or more dry strength agents to the surface of a Yankee dryer; (d) adhering the tissue web to the surface of the Yankee dryer such that the dry strength agent is transferred to the tissue web; and (e) creping the web.

In another aspect, the invention resides in a creped tissue having a dryer side surface and an air side surface and containing a dry strength agent, wherein the concentration of the dry strength agent on the dryer side surface is greater than the concentration on the air side surface.

In another aspect, the invention resides in a tissue product made by the above-mentioned method.

Suitable dry strength agents used in conjunction with or as part of the creping adhesive formulation include a range of chemistries that contribute dry strength to the tissue. These agents include, but are not limited to, modified starches (cationic or amphoteric) and their derivatives, gums (natural or cationic), and polyacrylamides.

The amount of dry strength agent added to the Yankee dryer can be any amount that is effective in increasing the dry integrity of the resulting tissue and will depend on the particular agent selected and the desired strength effect. Nevertheless, suitable amounts of dry strength agent, expressed as the weight percent solids based on the dry weight of fiber, can be about 0.05 weight percent or greater, more specifically from about 0.2 to about 1 weight percent, and still more specifically from about 0.3 to about 0.5 weight percent.

As used herein, the recitation of specific ranges, such as weight percent amounts, is intended to include all subranges within the specified ranges even though the subranges are not specifically recited because they are too numerous to mention.

The addition of one or more dry strength agents in accordance with the method of this invention imparts a dry strength to the resulting tissue characterized by a machine direction (MD) tensile strength of about 1100 grams or greater per 3 inches of sample width and a cross-machine direction (CD) tensile strength of about 700 grams or greater per 3 inches of sample width. The exact level of tensile strength will depend on the specifications required for a particular product form. The amount of dust and lint accumulated will also be dependent upon the product form but will be less than if the dry strength agent is added to the furnish at the wet end of the tissue making process.

The MD and CD dry tensile strength of a tissue are determined by using a double-edged cutter to cut two, 3-inch wide tissue strips of the tissue to be tested in either direction. If the tissue sample is a two-ply product, only two strips are cut to yield a two-ply sample. The length of the sample strips are approximately 6 inches. The resulting two-ply specimen is conditioned in a standard atmosphere (23° C. and 50% relative humidity) for four hours. The two-ply strip is promptly placed in the jaws of an Instron Tensile Tester (Model No. 1122) with a slight amount of slack. The gauge length is four inches and the crosshead speed is 10 inches per minute with a 10 pound full scale load. After each sample test, the tensile reading at failure is recorded as the dry tensile strength of the tissue sample per two-ply. About ten tensile tests should be run for each tissue sample to provide a meaningful statistical average value for the particular tissue tested.

DETAILED DESCRIPTION OF THE DRAWING

Figure 1:
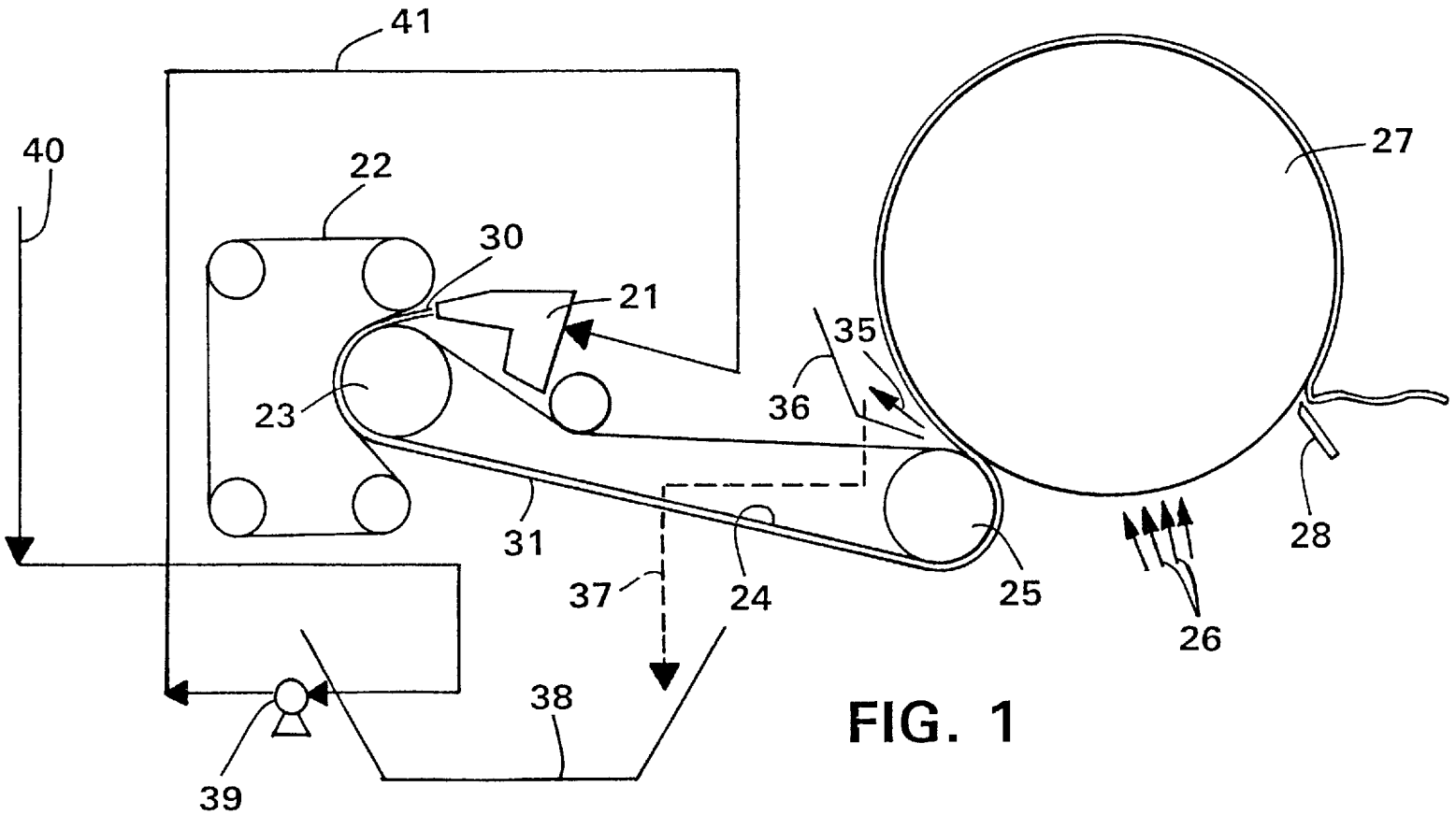
FIG. 1 is a schematic flow diagram of a wet-pressed tissue making process, illustrating the addition of dry strength agents to the surface of the Yankee dryer. Also shown is the white water recycle flow.

FIG. 1 is a schematic flow diagram of a conventional wet-pressed tissue making process useful in the practice of this invention, although other tissue making processes can also benefit from the stock prep method of this invention, such as throughdrying or other non-compressive tissue making processes. The specific formation mode illustrated in FIG. 1 is commonly referred to as a crescent former, although many other formers well known in the papermaking art can also be used. Shown is a headbox 21, a forming fabric 22, a forming roll 23, a paper making felt 24, a press roll 25, a spray boom 26, Yankee dryer 27, and a creping blade 28. Also shown, but not numbered, are various idler or tension rolls used for defining the fabric runs in the schematic diagram, which may differ in practice. As shown, the headbox 21 continuously deposits a stock jet 30 between the forming fabric 22 and felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web 31 stays with the felt and is transported to the Yankee dryer 27.

At the Yankee dryer, the creping chemicals are continuously applied in the form of an aqueous solution to the surface of the Yankee dryer on top of the residual adhesive remaining after creping. In accordance with this invention, the creping chemicals can include one or more dry strength agents. The solution is applied by any conventional means, preferably using a spray boom 26 which evenly sprays the surface of the dryer with the creping adhesive solution. The point of application on the surface of the dryer is immediately following the creping doctor blade 28, permitting sufficient time for the spreading and drying of the film of fresh adhesive before contacting the web in the press roll nip.

The wet web 31 is applied to the surface of the dryer by means of the press roll or pressure roll 25 with an application force typically of about 200 pounds per square inch (psi). The incoming web is nominally at about 10% consistency (range from about 8 to about 20%) at the time it reaches the press roll. Following the pressing and dewatering step, the consistency of the web is at or above about 30%. The side of the web in contact with the surface of the Yankee dryer is referred to herein as the "dryer side" of the web. The opposite side of the web is referred to as the "air side" of the web. Sufficient Yankee dryer steam power and hood drying capability are applied to this web to reach a final moisture content of about 2.5% or less.

Also illustrated in FIG. 1 is the white water recycle system. At the press roll nip, white water effluent 35 expressed from the wet web is collected in catch pan 36. Because of the presence of a substantial amount of water in the pressure roll nip, some of the dry strength agent is transferred from the surface of the Yankee into the white water, which also contains fines. The collected white water 37 drains into wire pit 38. Thick stock 40 having a consistency of about 2 percent is diluted with white water at the fan pump 39 to a consistency of about 0.1 percent. The diluted stock 41 is subsequently injected into the headbox 21 to form the wet web.

EXAMPLES

Example 1

(Control)

A soft, strong, absorbent tissue product was made in accordance with this invention using the overall process of FIG. 1. More specifically, a papermaking furnish was prepared consisting of 35% northern softwood kraft (NSWK) and 65% Eucalyptus fibers. Each fiber type was pulped separately and subsequently blended together. An amphoteric starch dry strength agent (Redi-Bond 2038, commercially available from National Starch and Chemical Company) and a wet strength agent (Kymene 557LX, commercially available from Hercules, Inc.) were sequentially added to the blended furnish. The Kymene 557LX was added as a 1 percent aqueous mixture. The addition rate was 0.16 weight percent based on dry fiber. The Redi-Bond 2038 was also added as a 1 percent aqueous mixture and the addition rate was 0. 16 weight percent based on dry fiber. The resulting furnish was diluted to a consistency of about 0.6 dry weight percent.

The blended furnish was then further diluted to about 0.1 weight percent based on dry fiber, fed to a headbox and deposited from the headbox onto a multi-layer polyester forming fabric to form the tissue web. The web was then transferred from the forming fabric to a conventional wet-pressed carrier felt. The water content of the sheet on the felt just prior to transfer to the Yankee dryer was about 88 percent. The sheet was transferred to the Yankee dryer with a vacuum pressure roll. Nip pressure was about 230 pounds per square inch. Sheet moisture after the pressure roll was about 45 percent. The adhesive mixture sprayed onto the Yankee surface just before the pressure roll consisted of 40% polyvinyl alcohol, 40 percent polyamide resin (Kymene LX) and 20 percent Quaker 2008. The spray application rate was about 5.5 pounds of dry adhesive per ton of dry fiber. A natural gas heated hood partially enclosing the Yankee had a supply air temperature of 533 degrees Fahrenheit to assist in drying. Sheet moisture after the creping blade was about 1.5 percent. Machine speed was 4500 feet per minute. The crepe ratio was 1.27, or 27 percent. The resulting tissue was plied together and lightly calendered with two steel rolls at 10 pounds per lineal inch. The two-ply product had the dryer side plied to the outside. When converted, the finished basis weight of the two-ply bath tissue at TAPPI standard temperature and humidity was 22.0 pounds per 2880 square feet. The CD wet tensile strength was about 135 grams per 3 inches. The MD and CD dry tensiles were approximately 1050 and 550g respectively.

Example 2

(Invention)

A tissue was made as described in Example 1 with an additional 2 dry pounds of Redi-Bond 2038 per tonne of fiber added to the creping adhesive mixture. To compensate for the overall increased dry strength, approximately 1 dry pound per tonne of Redi-Bond 2038 was removed from the normal wet-end addition point. The dry tensile strengths were similar to Example 1 with the added advantage of lower dust accumulation during manufacturing and converting and lower lint levels while dispensing and during actual use.

It will be appreciated that the foregoing description and examples, given for purposes of illustration, are not to be construed as limiting the scope of this invention, which is defined by the following claims and all equivalents thereto.

I claim:

1. A method for making a creped tissue comprising: (a) forming a wet tissue web by depositing an aqueous papermaking furnish onto a forming fabric; (b) partially dewatering the tissue web; (c) applying a creping adhesive and one or more dry strength agents to the surface of a Yankee dryer, said dry strength agent being selected from the group consisting of modified starches, gums, and polyacrylamides; (d) adhering the tissue web to the surface of the Yankee dryer with a pressure roll such that the dry strength agent is transferred to the tissue web wherein water is removed from the web and water and the dry strength agent are recycled to the aqueous papermaking furnish of step (a); and (e) creping the web.

2. The method of claim 1 wherein the amount of the dry strength agent added to the Yankee dryer surface is about 0.05 weigh percent, based on the dry weight of fiber in the tissue.

3. The method of claim 1 wherein the amount of dry strength agent added to the Yankee dryer surface is from about 0.2 to about 1 weight percent, based on the dry weight of fiber in the tissue.

4. The method of claim 1 wherein the amount of dry strength agent added to the Yankee dryer surface is from about 0.3 to about 0.5 weight percent, based on the dry weight of fiber in the tissue.

5. The method of claim 1 wherein the dry strength agent is a modified starch.

6. The method of claim 1 wherein the dry strength agent is a gum.

7. The method of claim 1 wherein the dry strength agent is a polyacrylamide.

* * * * *